US007155832B2

(12) United States Patent
Warfel et al.

(10) Patent No.: US 7,155,832 B2
(45) Date of Patent: Jan. 2, 2007

(54) CHAIN SAW WITH TOOL-LESS CHAIN TENSIONER AND GUIDE BAR LOCK

(75) Inventors: Paul A. Warfel, Texarkana, TX (US); Steven McKeithen, Texarkana, TX (US); Dennis Zapanata, Texarkana, TX (US); William B. Keeton, Nash, TX (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 39 days.

(21) Appl. No.: 11/069,799

(22) Filed: Mar. 1, 2005

(65) Prior Publication Data

US 2006/0196058 A1 Sep. 7, 2006

(51) Int. Cl.
*B27B 17/14* (2006.01)

(52) U.S. Cl. ..... 30/386; 30/383

(58) Field of Classification Search ..... 30/381, 30/383, 386; 83/816
See application file for complete search history.

(56) References Cited

U.S. PATENT DOCUMENTS

| | | | | |
|---|---|---|---|---|
| 3,636,995 | A | 1/1972 | Newman | |
| 3,866,320 | A | 2/1975 | Progt | |
| 4,129,943 | A | 12/1978 | Bricker | |
| 4,316,327 | A | 2/1982 | Scott et al. | |
| 4,383,334 | A | 5/1983 | Epsom | |
| 4,567,658 | A | 2/1986 | Wissmann et al. | |
| 4,920,650 | A | 5/1990 | Edlund | |
| 5,070,618 | A | 12/1991 | Edlund | |
| 5,174,029 | A | 12/1992 | Talberg | |
| 5,177,871 | A | 1/1993 | Martenson | |
| 5,345,686 | A | 9/1994 | Zimmermann | |
| 5,491,899 | A | 2/1996 | Schliemann et al. | |
| 5,497,557 | A | 3/1996 | Martinsson | |
| 5,522,143 | A | 6/1996 | Schleimann et al. | 30/386 |
| 5,528,835 | A | 6/1996 | Ra | |
| 5,896,670 | A | 4/1999 | Gibson et al. | |
| 6,049,986 | A | 4/2000 | Calkins et al. | 30/386 |
| 6,061,915 | A | 5/2000 | Seigneur et al. | |
| 6,148,525 | A | 11/2000 | Mizutani et al. | |
| 6,493,949 | B1 | 12/2002 | Kondo et al. | 30/386 |
| 6,560,879 | B1 * | 5/2003 | Franke et al. | 30/386 |
| 6,564,459 | B1 | 5/2003 | Steinbrueck et al. | 30/383 |
| 6,694,623 | B1 | 2/2004 | Haughey | |

(Continued)

FOREIGN PATENT DOCUMENTS

WO WO 2004/078434 A1 9/2004

(Continued)

*Primary Examiner*—Hwei-Siu Payer
(74) *Attorney, Agent, or Firm*—Pearne & Gordon LLP

(57) ABSTRACT

A chain saw includes an engine, a chassis, and a clutch cover. A guide bar is adjustable relative to the chassis and the clutch cover, but stationary while in a secured position. An adjustment arrangement moves the guide bar to tension a chain, and includes a member operatively connected to the bar, intermeshed drive components to move the bar, and a manually engaged member that is operated without use of any tool. A guide bar securing arrangement has a knob rotatable between a tightened and loosened positions. In the loosened position, the guide bar may be adjusted. A knob handle of the securing arrangement is pivotable between a stowed position and an operation position. A lock arrangement, associated with the knob and knob handle, includes portions that cooperate to prevent the knob from rotating when the knob handle is in the stowed position.

7 Claims, 7 Drawing Sheets

U.S. PATENT DOCUMENTS

| | | | | |
|---|---|---|---|---|
| 6,782,627 | B1 | 8/2004 | Hermes et al. | 30/386 |
| 6,877,233 | B1 * | 4/2005 | Franke | 30/386 |
| 2001/0042311 | A1 | 11/2001 | Kondo et al. | 30/386 |

FOREIGN PATENT DOCUMENTS

| | | |
|---|---|---|
| WO | WO 2004/078435 A1 | 9/2004 |

* cited by examiner

CHAIN SAW WITH TOOL-LESS CHAIN TENSIONER AND GUIDE BAR LOCK

FIELD OF THE INVENTION

The invention relates to an arrangement that facilitates periodic tensioning of an endless cutting chain on a guide bar of a chain saw.

BACKGROUND OF THE INVENTION

A cutting chain of a chain saw may become loose on a guide bar after some amount of use because of factors such as wear that results in elongation (i.e., stretch) of chain. Several saw constructions and associated methods exist to move the guide bar longitudinally away from a body and drive sprocket of the chain saw to take slack out of the cutting chain and ensure that links of the cutting chain remain snugly seated in a peripheral channel in the guide bar.

A number of the constructions and associated methods require an operator to loosen a retaining assembly using one or more separate tools, to grasp and move the guide bar longitudinally from the chassis to increase cutting chain tension, and then to re-tighten the retaining assembly to retain the guide bar. In other constructions and associated methods, a tool-engaged screw is integrated into the chain saw to move the guide bar. For some of these other constructions, a retaining assembly is loosened and tightened accordingly. Further, the loosening and tightening may be accomplished via one or more separate tools. Another type of chain saw does not require the use of separate tools for loosening the retaining assembly, moving the guide bar, and tightening the assembly. However, continuing improvement is always desirable.

Also it is to be appreciated that an inherent aspect of many types of chain tightening arrangements is the movement of the guide bar. Thus, the guide bar must be movable during an adjustment procedure. However, once adjustment is accomplished, the guide bar is to be held against movement. Here also, it would be beneficial to permit loosening and accomplish securing of the guide bar without the use of tools. Moreover, maintenance of the guide bar in a secured position is beneficial.

SUMMARY OF THE INVENTION

In accordance with one aspect, the present invention provides a chain saw that includes an engine, an engine chassis supporting the drive engine, and a clutch cover securable relative to the engine. The chain saw includes a guide bar adjustable relative to the engine chassis and the clutch cover. The guide bar is stationary relative to the clutch cover and the engine chassis while in a secured position. The chain saw includes a cutting chain extending along the guide bar and operatively connected to be driven by the engine. The chain saw includes an adjustment arrangement for moving the guide bar to an adjusted position and tension the chain. The adjustment arrangement includes a member operatively connected to the guide bar, a sequence of intermeshed drive components operable to cause movement of the guide bar, and a manually engaged member that is operated without use of any tool to cause operation of the intermeshed drive components and move the guide bar. The chain saw includes a guide bar securing arrangement including a rotatable knob operatively cooperative with the engine chassis, the clutch cover, and the guide bar, wherein the knob may be rotated between a tightened position, in which the guide bar is tightened between the engine chassis and the clutch cover, and a loosened position, in which the guide bar is loosened and may be adjusted, and a knob handle, having an end portion pivotally connected to the knob. The guide bar securing arrangement further includes a lock portion extending from the end portion. The knob handle is pivotable between a stowed position and an operation position. The chain saw includes a lock arrangement associated with the knob and knob handle. The lock arrangement includes portions that cooperate to permit the knob to be rotated when the knob handle is in the operation position and prevent the knob from rotating when the knob handle is in the stowed position.

BRIEF DESCRIPTION OF THE DRAWINGS

The forgoing and other features and advantages are set forth in the following description and in the accompanying drawings, in which.

DESCRIPTION OF AN EXAMPLE EMBODIMENT

Figure 1:
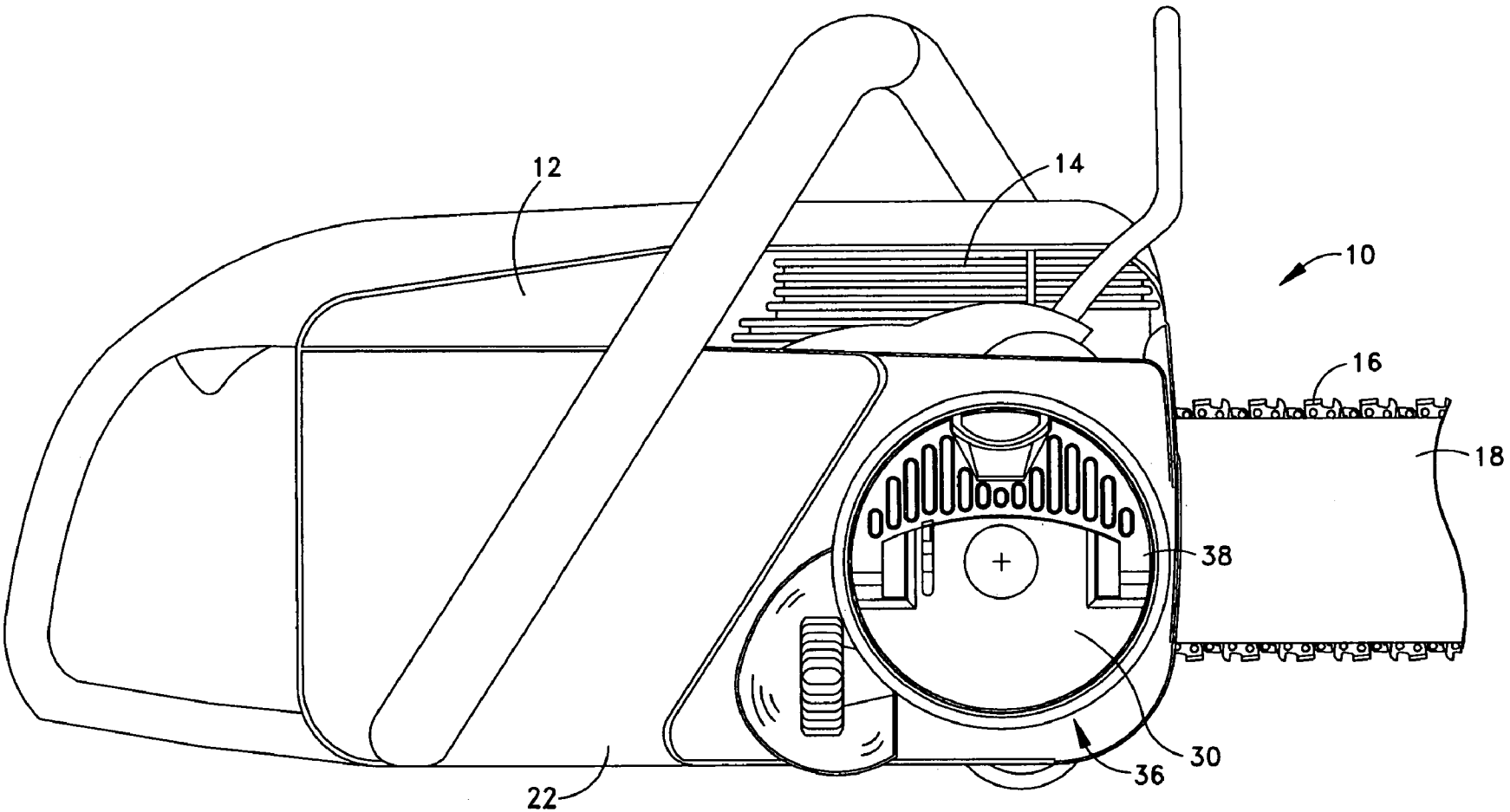
FIG. 1 is a side view of a portion of a chain saw that includes an example of a tool-less chain tensioner and guide bar lock in accordance with the present invention.

FIG. 1 illustrates a chain saw 10 that includes an example of a tool-less chain tensioner and guide bar lock in accordance with the present invention. The chain saw 10 has an engine chassis 12 that supports an engine 14 located on the chassis. As will be appreciated by the person skilled in the art, the engine 14 turns a drive sprocket (not visible) attached to a drive shaft (not visible) of the engine. The drive sprocket engages the links of an endless cutting chain 16 and propels the chain around a guide bar 18.

Figure 2:
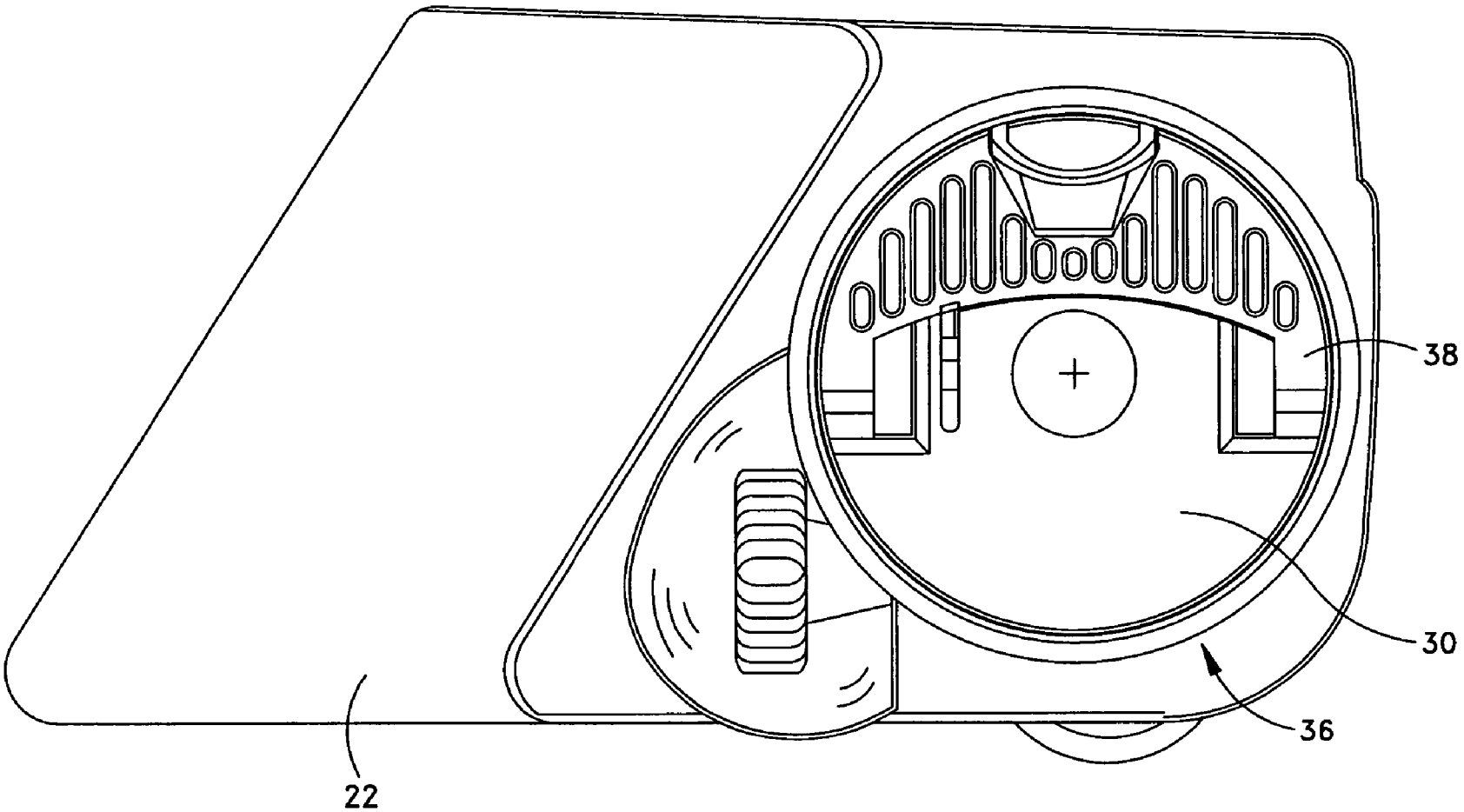
FIG. 2 is an enlarged side view of a portion of the chain saw of FIG. 1 providing the tool-less chain tensioner and guide bar lock aspects.
Figure 3:
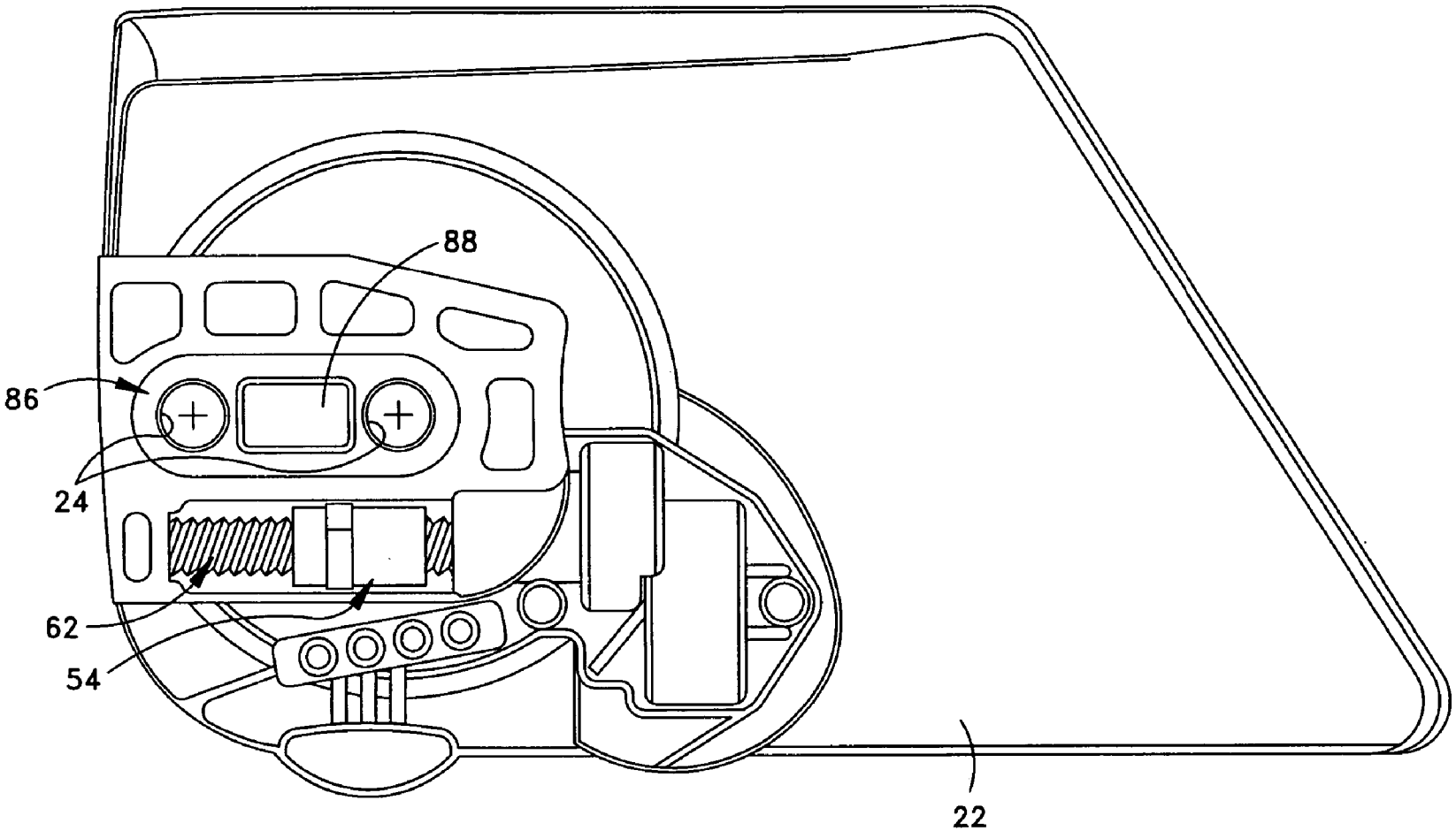
FIG. 3 is a reverse-angle side view of the portion shown in FIG. 2 and specifically shows the example parts for the tool-less chain tensioner.
Figure 4:
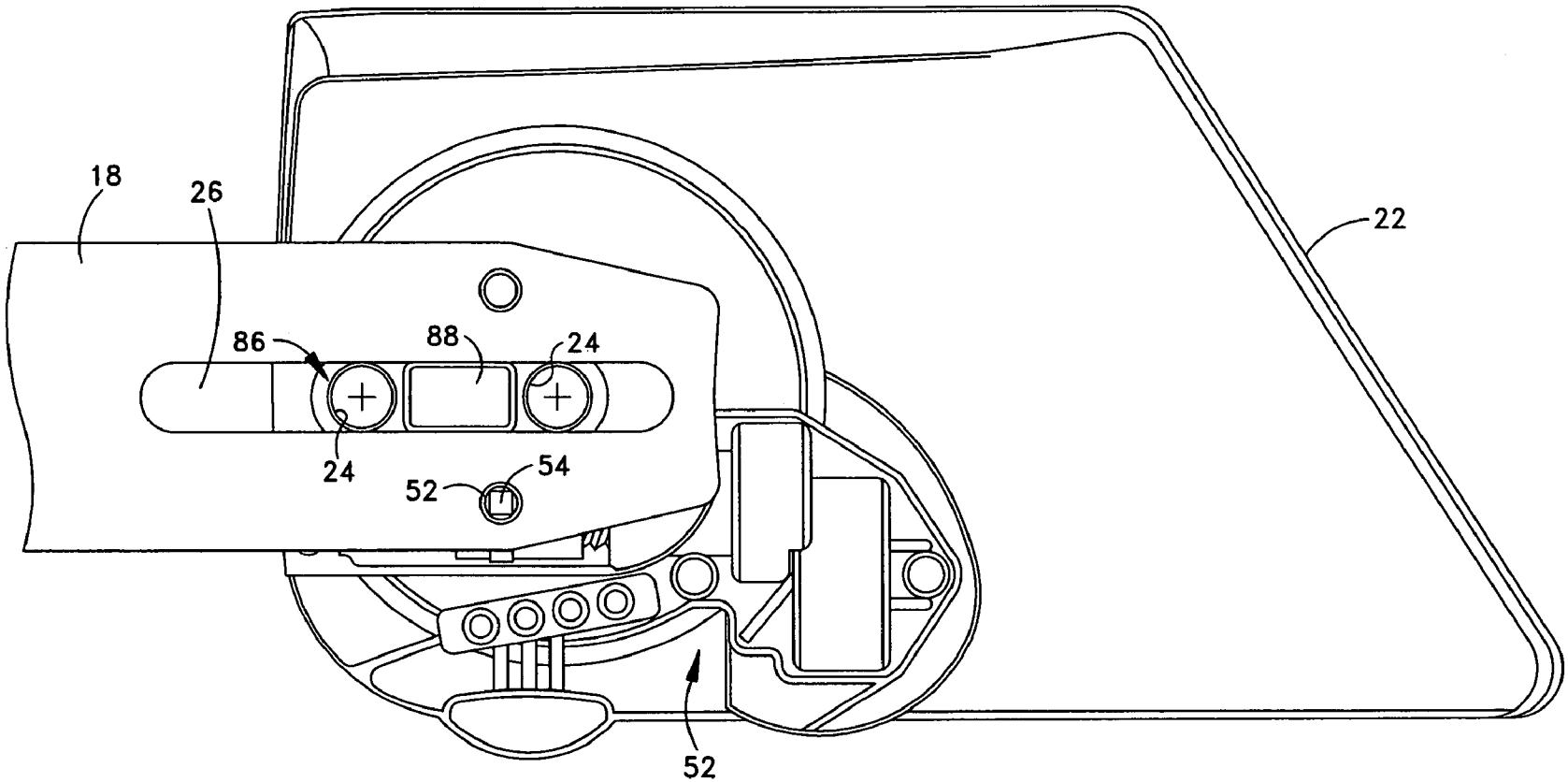
FIG. 4 is a view similar to FIG. 3, but additionally shows a guide bar of the chain saw cooperating with the parts for the tool-less chain tensioner.

The guide bar 18 is of an elongated plate configuration with a channel or groove (not visible) around its periphery and an idler sprocket (not shown) at its distal end into which the links of the cutting chain 16 ride. A rear end portion of the guide bar is located between the chassis 12 and a clutch cover 22 (FIG. 2). Parallel pins or studs (not visible) affixed to the engine chassis 12 lie in a common, generally horizontal plane and extend between the engine chassis and the clutch cover 22. Structures at the clutch cover 22 receive the studs. For example, receiving locations 24 are shown in FIGS. 3 and 4. The guide bar 18 (FIG. 4) has an elongated horizontal slot 26. In an assembled state of the chain saw 10, the slot 26 is aligned with the receiving locations 24. The studs extend perpendicularly through the slot 26 and into the receiving locations 24, as will be appreciated by the person of skill in the art. The studs align the guide bar 18 to the engine chassis 12 and, since the spacing between the studs is considerably less than the length of the slot 26, the guide bar is able to slide horizontally on the studs for the purpose of chain tension adjustment as described below.

The clutch cover 22 is made of any suitable material, such as a molded plastic or a die case metal material. It is to be appreciated that the clutch cover 22 is associated with securing the guide bar relative to the engine chassis 12 and movement of the guide bar 18 relative to the engine chassis to adjust the chain tension. As such, the clutch cover 22 provides a housing for components that secure/release the guide bar 18 concerning movement, lock/unlock the movement, and adjust the cutting chain. In general, it is to be appreciated that the clutch cover 22 is at least removably attached to the engine chassis 12 via one or both of the studs.

Figure 5:
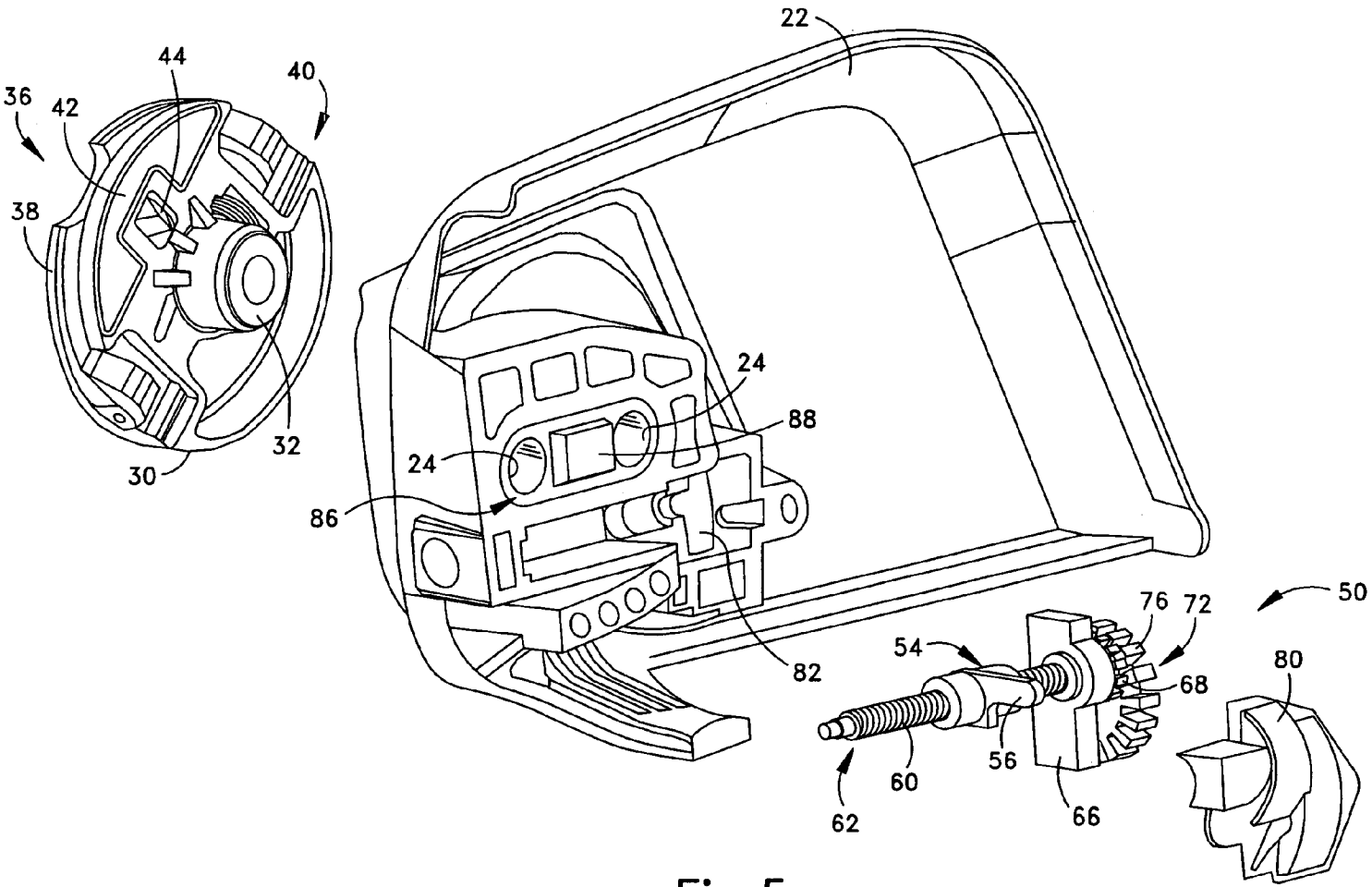
FIG. 5 is an exploded perspective view of the portion of the chain saw shown in FIG. 3 and shows the example parts providing the tool-less chain tensioner and guide bar lock.
Figure 6:
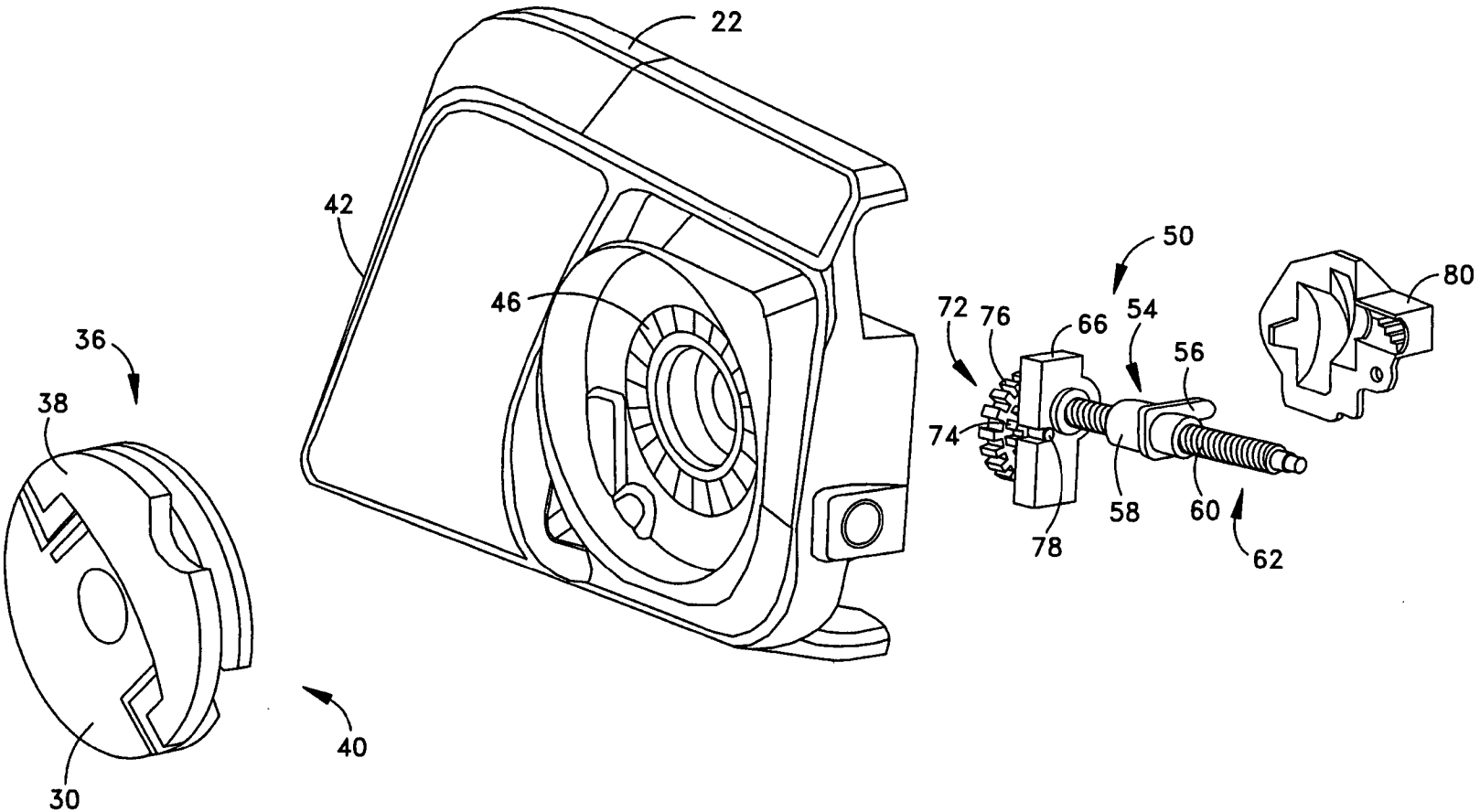
FIG. 6 is a reverse-angle exploded perspective view of the portion of the chain saw of shown in FIG. 5.

In the shown example embodiment, the clutch cover 22 is attached to the engine chassis 12 via one of the studs (e.g., a forward stud) being externally threaded and a knob 30 (FIG. 2), rotatably supported on the clutch cover, operatively interacting with the stud. In particular, the knob 30 has an insert 32 (FIG. 5) that is rotatable between a tightened position and a loosened position. In the tightened position, the clutch cover 22 is pressed toward the guide bar 18 and the engine chassis 12. Thus, the guide bar 18 is held or secured in a fixed position between the engine chassis 12 and the clutch cover 22. Accordingly, the knob 30 provides part of a guide bar securing arrangement 36. With the knob 30 in the loosened position, the guide bar 18 is permitted to move longitudinally. The movement of the guide bar 18 is associated with an adjustment movement that tightens the cutting chain as will be appreciated by the person skilled in the art.

The knob 30 has a knob handle 38 that is pivotally mounted on the knob via pins (not visible) that extend from the ends of the knob handle 38. The knob handle 38 is pivotable from a stowed position (shown in FIGS. 1 and 2), in which the entire knob handle is in close proximity to the rest of the knob 30, to an operational position, in which a portion of the knob handle is located away from the knob (i.e., the handle is up, out of the plane of FIG. 1). With the knob handle 38 in the operational position, the knob handle can be easily grasped and the knob 30 can be caused to rotate (e.g., between the tightened and loosened positions) without the use of additional tools. A small spring may be provided to bias the knob handle 38 toward the stowed position.

As mentioned above, with the clutch cover 22 in the loosened position, the guide bar 18 can move. A lock arrangement 40 is provided to prevent loosening of the knob 30 when the handle 38 is in the stowed position. In the shown example, a lock member 42 is associated with the handle 38 on the knob 30. The lock member 42 has an extending lock protrusion or tooth 44. The lock protrusion 44 extends from the handle 38 toward the clutch cover 22. The clutch cover 22 has a series of teeth 46 that extend about a rotational axis of the knob. A plurality of engagement points are located between the teeth 46. The lock protrusion 44 mates with one of the engagement points when the handle 38 is in the stowed position. In such a mated position, the teeth on the clutch cover adjacent to the particular engagement point prevent rotational movement of the lock protrusion 44 and thus prevent rotational movement of the knob 30. It is to be appreciated that presence of the handle 38 being in the stowed position can provide a visual indication that the handle is thus locked via the lock arrangement 40.

It is to be appreciated that the lock arrangement 40 may be modified. For example, plural lock protrusions may be provided on the lock member, the teeth on the clutch cover may not completely encircle the axis, or the protrusion and the teeth may be positioned such that the protrusion extends radially outward from the knob and the teeth are located radially outward of the knob.

Turning now to the issue of accomplishing the movement of the guide bar 18, when the knob 30 is unlocked and loosened thus the clutch cover 22 and guide bar are loosened, to adjust chain tension, an adjustment arrangement 50 is provided. In the shown example, an opening 52 is provided in the guide bar 18. In the shown example, the opening 52 is adjacent to the slot 26. A bar adjust pin 54 has a portion 56 that extends into the opening 52. Thus, the bar adjust pin 54 is operatively connected to the guide bar 18. Another portion 58 of the adjust pin 54 is internally threaded, and is mated with and an externally-threaded portion 60 of a bar adjust screw 62. The threaded portion 60 is elongate, and the adjust pin 54 travels along the length of the threaded portion as the adjust screw 62 is rotated. Specifically, the adjust pin 54 is moved along the helix of the threads of threaded portion 60 of the adjust screw 62 as the adjust screw rotates. As the adjust pin 54 moves, the guide bar 18 is also moved.

A support plate 66 is fixed relative to the clutch cover 22 and the adjust screw 62 extends though the plate. A gear 68 is secured to an end of the adjust screw 62 and has an outer peripheral array of teeth. Rotation of the gear 68 causes direction rotation of the adjust screw 62.

A manually operated bar adjust wheel 72 has a gear portion 74 with gear teeth that mesh with the teeth of the gear 68. As such, rotation of the adjust wheel 72, with the gear portion 74, causes rotation of the gear 68. A second portion 76 of the adjust wheel 72 is engaged by hand to rotate the adjust wheel. An outer periphery of the second portion 76 of the adjust wheel 72 that is manually engaged has a contour (e.g., grooves, knurling, serration or the like) that provides for ease of transfer of manual force to rotate the adjust wheel. A support pin portion 78 of the adjust wheel 72 extends into a mating aperture on the support plate 66 such that the adjust wheel and the gear 68 are held in meshing engagement such that the rotation of the adjust wheel 72 causes the rotation of the gear and thus the adjust pin 54. Thus, the adjustment arrangement 50 has a sequence of intermeshed drive components operable to cause movement of the guide bar 18.

A gearbox cover 80 extends over one side of the gear 68, the adjust wheel 72, and the support plate 66. The gearbox cover 80 is secured to the clutch cover 22 via any suitable means, such as via screws. The gearbox cover 80 helps to maintain the components in place.

It is to be appreciated that the outer periphery of the second portion 76 of the adjust wheel 72 extends through an opening 82 in the clutch cover 22. As such, the manually engagable portion 76 is accessible from the exterior of the chain saw 10 (i.e., there is no need for any disassembly or part removal to manually operate the adjust wheel 72.

In operation of the adjustment arrangement 50, which is done with the guide bar 18 unlocked and loosened to permit movement for chain tensioning, the adjust wheel 72 is rotated by hand and without a tool. Rotation of the adjust wheel 72 causes rotation of the gear 68. In turn, the gear 68 and the adjust screw 62 rotate together. As the adjust screw 62 rotates, the adjust pin 54 moves and pushes the guide bar 18 to move. Thus, the adjustment arrangement 50 has a manually engaged member that is operated without use of any tool to cause operation of a sequence of intermeshed drive components and move the guide bar 18.

Although the above-described example of the present invention is complete, it is to be appreciated that some additional modifications are possible to address various details. For example, it is possible that the amount of force that can be manually transferred to the adjust wheel 72 may less than an amount of force that would be transferred within an adjustment arrangement that is operated via a tool. In general, it is to be appreciated that the use of a tool is often associated with an increased ability to provide force.

One aspect of the adjustment arrangement 50 that may provide some level of difficulty of operation at the level of force that is manually provided is the threaded interaction between the adjust screw 62 and the adjust pin 54. Specifically, the force transfer is rotational to linear and as such there may be a tendency to have difficulty, restriction or the like. As such, one additional aspect that may be utilized in connection with the present invention is a construction/configuration that alleviates difficulty, restriction, or the like. In the shown example, the internally-threaded portion 58 of the adjust pin 54 is elongated. Thus, in some respects the internally-threaded portion 58 can be considered to be a barrel.

Figure 8:
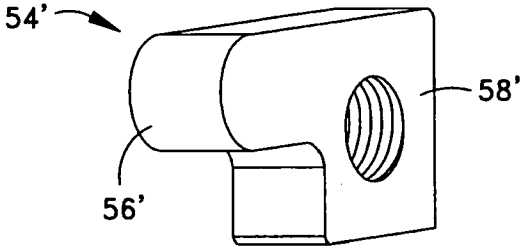
FIG. 8 is a further enlarged view of one part previously contemplated for use in the chain tensioner and provided for comparison purposes to a part shown in FIG. 7.
Figure 7:
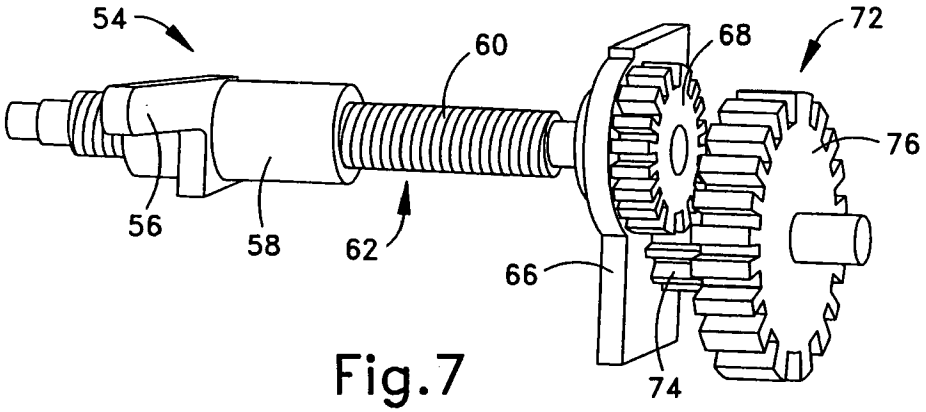
FIG. 7 is an enlarged view of some of the parts for the tool-less chain tensioner.

As a point of reference comparison, attention is directed to FIG. 8. A previously contemplated construction for an adjust pin 54' is shown. Portions of the adjust pin 54' (FIG. 8) that are comparable to portions on the adjust pin 54 (FIG. 7) are indicated by the same numerals, but with an added "'" (prime). It should be noted that the portion 58' (FIG. 8) for threaded engagement with the adjust screw 62 is relatively short compared to the corresponding portion 58 of the adjust pin 54 shown in FIG. 7. In one example concerning the construction of the adjust pin 54 (FIG. 7), the length of the internally-threaded portion 58 (i.e., the barrel) is larger than the diameter of the adjust screw 62. In one specific example concerning the construction of the adjust pin 54, the length of the internally-threaded portion 58 (i.e., the barrel) about or at least twice the diameter of the adjust screw 62.

Figure 10:
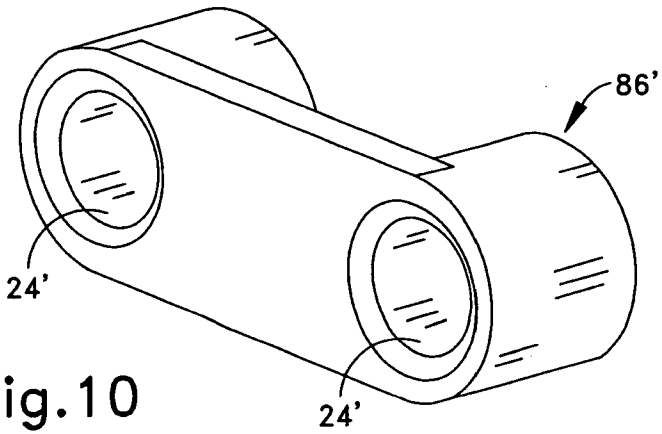
FIG. 10 is a view of one part previously contemplated for use in the chain tensioner and provided for comparison purposes to the part shown in FIG. 9.
Figure 9:
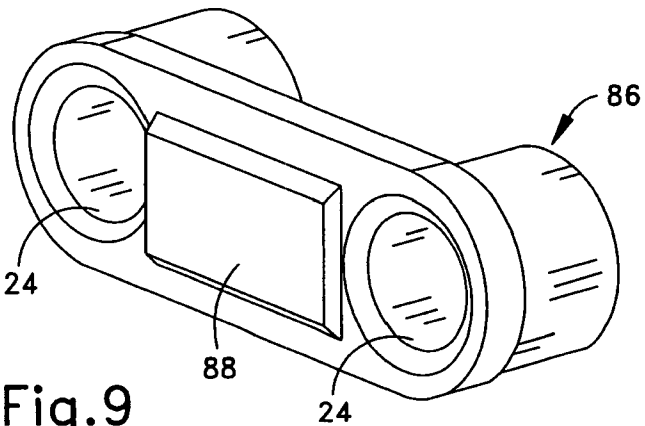
FIG. 9 is a further enlarged view of one part shown in FIGS. 3–5, which may be provided for improved operation of the tool-less chain tensioner.

Another aspect that may merit consideration is the aspect of assembly. It should be appreciated that there may be a some level of difficulty associated with assembly of the chain saw 10 with the tool-less chain tensioner and guide bar lock. FIG. 9 shows an insert 86 that is associated with receipt of the studs at the clutch cover 22. The insert 86 is received into the clutch cover 22 and has apertures as the receiving locations 24 through which the studs extend. The insert 86 provides support to bear against the guide bar 18, as will be appreciated by the person skilled in the art. In one example, the insert 86 is molded into the clutch cover 22. As a point of reference comparison, attention is directed to FIG. 10. A previously contemplated construction for an insert 86' is shown. As can be seen the insert 86' has apertures as the receiving locations 24. However, the insert 86' does not have a projection, but merely has a surface that does not have any guide bar retaining structure.

It should be appreciated that as the chain saw 10 is assembled, the guide bar 18 is located adjacent to the clutch cover 22 with the studs extending there through. The adjust pin 54 of the adjustment arrangement 50 must also be located within the opening 52 in the guide bar 18. Of course, the guide bar 18 and clutch cover 22 also need to be positioned adjacent to the engine chassis 12 and associated structure. In order to increase ease of assembly, the insert 86 is provided with a dovetail projection 88. In cross-section, the projection 88 has a bevel taper or dovetail profile extending along the horizontal direction. The protection 88 is located between the receiving location 24 and extends into the slot 26 on the guide bar 18.

A largest dimension (vertical) of the projection 88 is slightly greater than the corresponding dimension (vertical) of the slot 26 in the guide bar 18. As such, with the guide bar 18 located adjacent to the clutch cover 22 and the projection 88 extending through the slot 26, the dovetail profile of the projection provides a snug fit and helps to retain the guide bar.

It should be appreciated that the above-disucssed structures and features are not limiting on the present invention. For example, concerning the just-discussed use of a dovetail projection, it is contemplated that modifications associated with the use of the projection are possible. Examples of such modification include placement of a dovetail structure at the engine chassis rater than at the clutch cover. Thus, the guide bar would be held relative to the engine chassis rather than the clutch cover during assembly.

Also, other variations are possible in connection with the use of such a guide bar retaining projection. For example, the projection can be used with an arrangement that has only a single stud. The projection can be located to either side of the stud and can provide additional support. The projection can even be bifurcated such that a segment is located on each side of the stud. It is to be appreciated that the present invention can be utilized with various other features.

The present invention can provide various advantages. For example, the present invention can provide improved ease of movement of the guide bar. Also, the present invention can enable an operator to make such adjustments without additional tools, and it will allow for a lower tightening torque of the tensioning mechanism with a visible, locked-in tightened position.

From the above description of the invention, those skilled in the art will perceive improvements, changes and modifications in the invention. Such improvements, changes and modifications are intended to be covered by the appended claims.

What is claimed is:

1. A chain saw including:

an engine;

an engine chassis supporting the engine;

a clutch cover securable relative to the engine;

a guide bar adjustable relative to the engine chassis and the clutch cover, the guide bar being stationary relative to the clutch cover and the engine chassis while in a secured position;

a cutting chain extending along the guide bar and operatively connected to be driven by the engine;

an adjustment arrangement for moving the guide bar to an adjusted position and tension the chain, the adjustment arrangement including a member operatively connected to the guide bar, a sequence of intermeshed drive components operable to cause movement of the guide bar, and a manually engaged member that is operated without use of any tool to cause operation of the intermeshed drive components and move the guide bar;

a guide bar securing arrangement including a rotatable knob operatively cooperative with the engine chassis, the clutch cover, and the guide bar, wherein the knob can be rotated between a tightened position, in which the guide bar is tightened between the engine chassis and the clutch cover, and a loosened position, in which the guide bar is loosened and can be adjusted, and a knob handle, having an end portion pivotally connected to the knob, and a lock portion extending from the end portion, wherein the knob handle is pivotable between a stowed position and an operation position; and a lock arrangement associated with the knob and the knob handle, the lock arrangement including portions that cooperate to permit the knob to be rotated when the knob handle is in the operation position and prevent the knob from rotating when the knob handle is in the stowed position.

2. A chain saw as set forth in claim 1, wherein the cooperating portions of the lock arrangement include a plurality of fixed engagement points fixed relative to the clutch cover, and an engagement portion associated with the knob handle, wherein the engagement portion associated with the knob handle is engaged with a respective one of the fixed engagement points when the knob handle is in a locked position, and disengaged from the fixed engagement points when the knob handle is in an unlocked position.

3. A chain saw as set forth in claim 2, wherein the engagement portion includes a protrusion that moves with the knob handle toward and away from the clutch cover, and the protrusion mates with one of the engagement points when the knob handle is in the locked position.

4. A chain saw as set forth in claim 1, wherein the sequence of intermeshed drive components of the adjustment arrangement includes an adjust wheel that is rotated by hand and without a tool, a gear engaged with the adjust wheel and rotated when the adjust wheel is rotated, a screw connected to rotate with the gear, and an adjust pin engaged with the screw to move along the screw as the screw rotates, the adjust pin is engaged with the guide bar and moves the guide bar as the pin moves along the screw.

5. A chain saw as set forth in claim 4, wherein a portion of the adjust pin engaged with the screw has a length extending along the screw that is larger than a diameter of the screw.

6. A chain saw as set forth in claim 5, wherein the length of the portion of the adjust pin engaged with the screw is about twice the dimension of the diameter of the screw.

7. A chain saw as set forth in claim 1, wherein the guide bar has a slot, a dovetail projection extends into the slot.

* * * * *